US006439877B1

(12) United States Patent
Weiss

(10) Patent No.: US 6,439,877 B1
(45) Date of Patent: Aug. 27, 2002

(54) CONTROL DEVICE FOR A GAS-FIRED APPLIANCE

(75) Inventor: Cory A. Weiss, Warren, MI (US)

(73) Assignee: Effikal International, Inc., Orion, MI (US)

( * ) Notice: Subject to any disclaimer, the term of this patent is extended or adjusted under 35 U.S.C. 154(b) by 18 days.

(21) Appl. No.: 09/644,740

(22) Filed: Aug. 23, 2000

(51) Int. Cl.[7] ..... F23L 11/00
(52) U.S. Cl. ..... 431/20; 126/285 B
(58) Field of Search ..... 431/20; 126/285 B, 126/285 R; 236/1 G; 110/163

(56) References Cited

U.S. PATENT DOCUMENTS

| | | | | |
|---|---|---|---|---|
| 2,349,443 A | | 5/1944 | McCarty | |
| 3,273,625 A | * | 9/1966 | Holtzman et al. | 431/20 |
| 4,005,820 A | * | 2/1977 | Cress | 431/20 |
| 4,204,833 A | | 5/1980 | Kmetz et al. | |
| 4,254,759 A | * | 3/1981 | Schmidt | 431/20 |
| 4,406,396 A | | 9/1983 | Habegger | |
| 4,550,874 A | | 11/1985 | Clouser et al. | |
| 4,778,378 A | | 10/1988 | Dolnick et al. | |
| 4,846,400 A | | 7/1989 | Crouse | |
| 5,393,221 A | | 2/1995 | McNally | |

FOREIGN PATENT DOCUMENTS

| | | | | |
|---|---|---|---|---|
| DD | DL 137470 | * | 9/1979 | 236/1 G |

* cited by examiner

*Primary Examiner*—Sara Clarke
(74) *Attorney, Agent, or Firm*—Miller Canfield Paddock & Stone, PLC

(57) ABSTRACT

A device for controlling a gas-fired appliance is provided. The device includes a motor assembly having a shaft extending therefrom and a cam coupled to the shaft for rotation therewith. The cam is coupled to a damper plate of the gas-fired appliance and the plate is configured to rotate with the cam responsive to rotation of the motor shaft. The device further includes a printed circuit board having a control switch mounted thereon. The cam is configured to selectively actuate the control switch upon rotation of the cam. The inventive control device may also include a mounting plate to which the motor assembly and circuit board may be mounted. The mounting plate may be an injection-molded, plastic part. In accordance with the present invention the cam is supported on the printed circuit board as opposed to the mounting plate thereby ensuring an accurate positional relationship between the cam and the control switch. In one embodiment of the invention, a pair of support members are disposed on either side of a housing for the control switch on the printed circuit board and are fastened to the switch housing. The cam is then received and positioned by the support members.

20 Claims, 5 Drawing Sheets

FIG-5
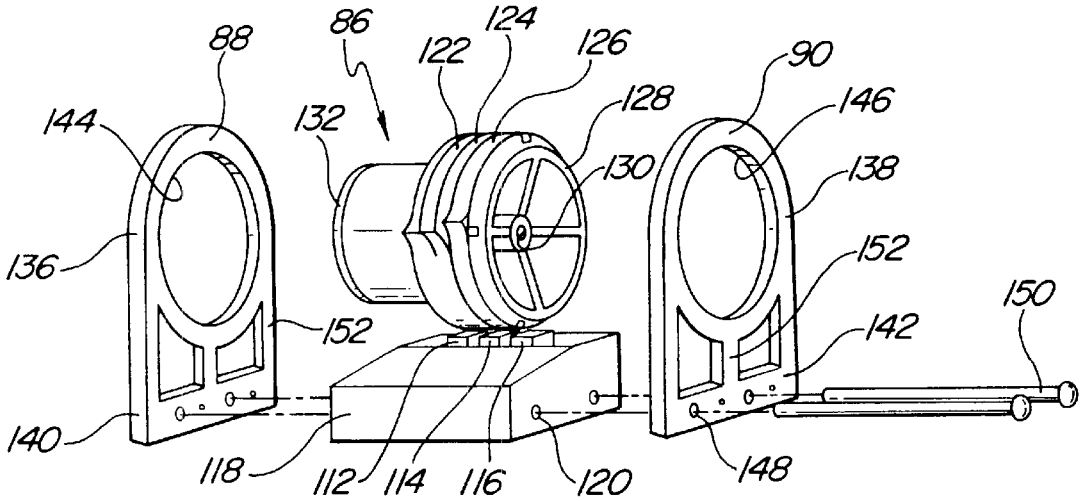
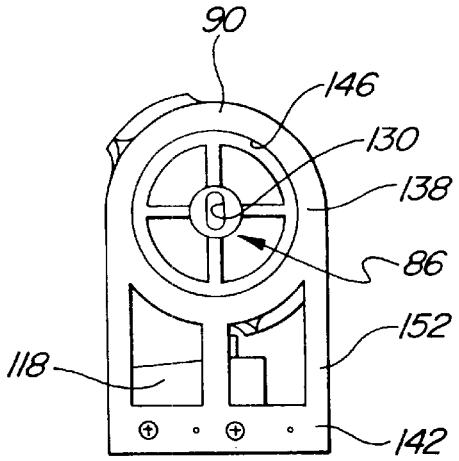
FIG-6
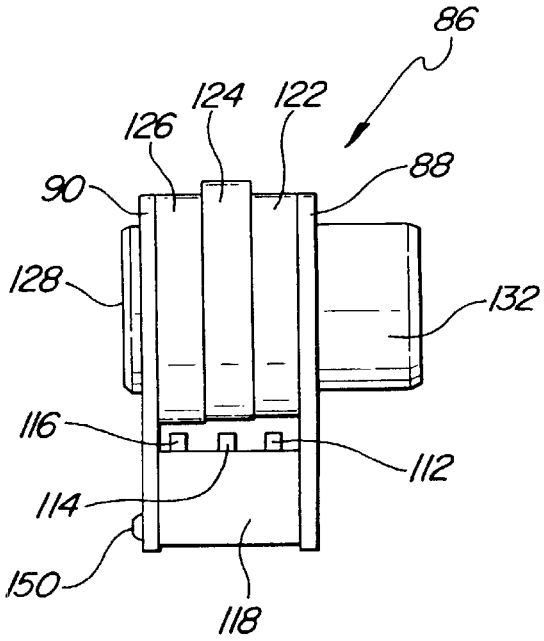
FIG-7

CONTROL DEVICE FOR A GAS-FIRED APPLIANCE

BACKGROUND OF THE INVENTION

1. Field of the Invention

This invention relates to gas-fired appliances such as water heaters, space heaters and fireplaces and, more particularly, to a device for controlling components commonly found in gas-fired appliances, namely, dampers and valves.

2. Disclosure of Related Art

In a conventional gas-fired appliance a gas pipe delivers a fuel gas, such as natural gas, from a fuel source to both a pilot burner and to a main burner that are disposed proximate, or within, a combustion chamber. The gas pipe includes a pair of valves disposed within the gas pipe. The first valve controls the flow of fuel gas from the fuel source to the pilot burner. The second valve controls the flow of fuel gas to the main burner.

Conventional gas-fired appliances also typically include an exhaust vent or flue to direct emissions resulting from combustion away from the combustion chamber of the appliance and into an area, such as the outdoors, where the emissions can dissipate. Exhaust vents, however, also allow heat to escape from the appliance thereby reducing the efficiency of the appliance. As a result, conventional gas-fired appliances typically include dampers disposed within the exhaust vent. The damper opens prior to ignition of the main burner in the appliance to allow emissions from combustion to be evacuated from the appliance. When the main burner is extinguished, the damper closes to trap the remaining heat.

Conventional gas-fired appliances also include a device for controlling one or more of the valves within the gas pipe and the damper in order to open and close the valves and the damper in response to predetermined conditions. Referring to FIG. 1, a typical control device 10 for a gas-fired appliance is illustrated. The control device 10 includes a motor assembly 12, a cam 14, a printed circuit board 16 upon which a control circuit is mounted, and a mounting plate 18 to support the components of device 10. The motor assembly 12 includes an output shaft 20 extending therefrom and is mounted to plate 18 by one or more fasteners 22 that extend through mounting flanges 24 on assembly 12 and into posts 26 extending from plate 18. Cam 14 is disposed about output shaft 20 and is coupled to shaft 20 for rotation therewith. One end 28 of cam 14 extends through an aperture (not shown) in plate 18 and is configured to receive a shaft 30 connected to a plate 32 of a damper 34. Circuit board 16 supports a control circuit used to control one or more valves and damper 34 of the gas-fired appliance. The control circuit includes a plurality of control switches 36, 38, 40 that are selectively actuated by rotation of cam 14. Board 16 is coupled to mounting plate 18 by one or more fasteners 42 that extend through a housing 44 for switches 36, 38, 40 and into corresponding apertures in either plate 18 or a mounting member affixed to plate 18.

The above-described control device has several disadvantages. First, cam 14 is positioned responsive to mounting plate 18 as opposed to switches 36, 38, 40. In particular, the position of cam 14 is dictated by the aperture in mounting plate 18. As a result, cam 14 may not be assembled in a proper positional relationship relative to switches 36, 38, 40 and the control circuit may not operate properly. This disadvantage is exacerbated by the tight tolerances found in plate 18 which typically comprises a metal stamping. The position of circuit board 16 can be adjusted to compensate for this deficiency, but repositioning board 16 increases assembly time and is subject to assembly errors. A second disadvantage of the above-described control device is that the device is relatively expensive. Finally, the above-described control device includes a relatively large number of parts and requires a relatively large amount of assembly time.

There is thus a need for a device for controlling a gas-fired appliance that will minimize or eliminate one or more of the above-mentioned deficiencies.

SUMMARY OF THE INVENTION

The present invention provides a device for controlling a gas-fired appliance such as a water heater, space heater, or fireplace.

A device in accordance with the present invention for controlling a gas-fired appliance includes a motor assembly having a shaft extending therefrom and a cam coupled to the shaft for rotation therewith. The cam is coupled to a damper plate of the gas-fired appliance and the plate is configured to rotate with the cam responsive to rotation of the motor shaft. The device further includes a printed circuit board having a control switch mounted thereon. The cam is configured to selectively actuate the control switch upon rotation of the cam. The inventive control device may also include a mounting plate to which the motor assembly and circuit board may be mounted. The mounting plate may be an injection-molded, plastic part. In accordance with the present invention the cam is supported on the printed circuit board as opposed to the mounting plate. In one embodiment of the invention, a pair of support members are disposed on either side of a housing for the control switch on the printed circuit board and are fastened to the switch housing. The cam is then received and positioned by the support members.

A device in accordance with the present invention represents a significant improvement as compared to conventional control devices for gas-fired appliances. In the inventive control device, the cam is positioned relative to the circuit board and the control switches disposed on the board as opposed to being positioned relative to the mounting plate. As a result, an accurate positional relationship between the cam and the control switches is ensured. Second, the inventive control device is less expensive than conventional control devices because it requires fewer parts, may be assembled more quickly, and uses an injection-molded plastic mounting plate as opposed to a stamped metal mounting plate.

These and other features and objects of this invention will become apparent to one skilled in the art from the following detailed description and the accompanying drawings illustrating features of this invention by way of example.

BRIEF DESCRIPTION OF THE DRAWINGS

FIG. 5 is an exploded perspective view of several components of the control device of FIGS. 3–4.

FIGS. 6 and 7 are plan views of several components of the control device of FIGS. 3–4.

DETAILED DESCRIPTION OF THE PREFERRED EMBODIMENT

Figure 2:
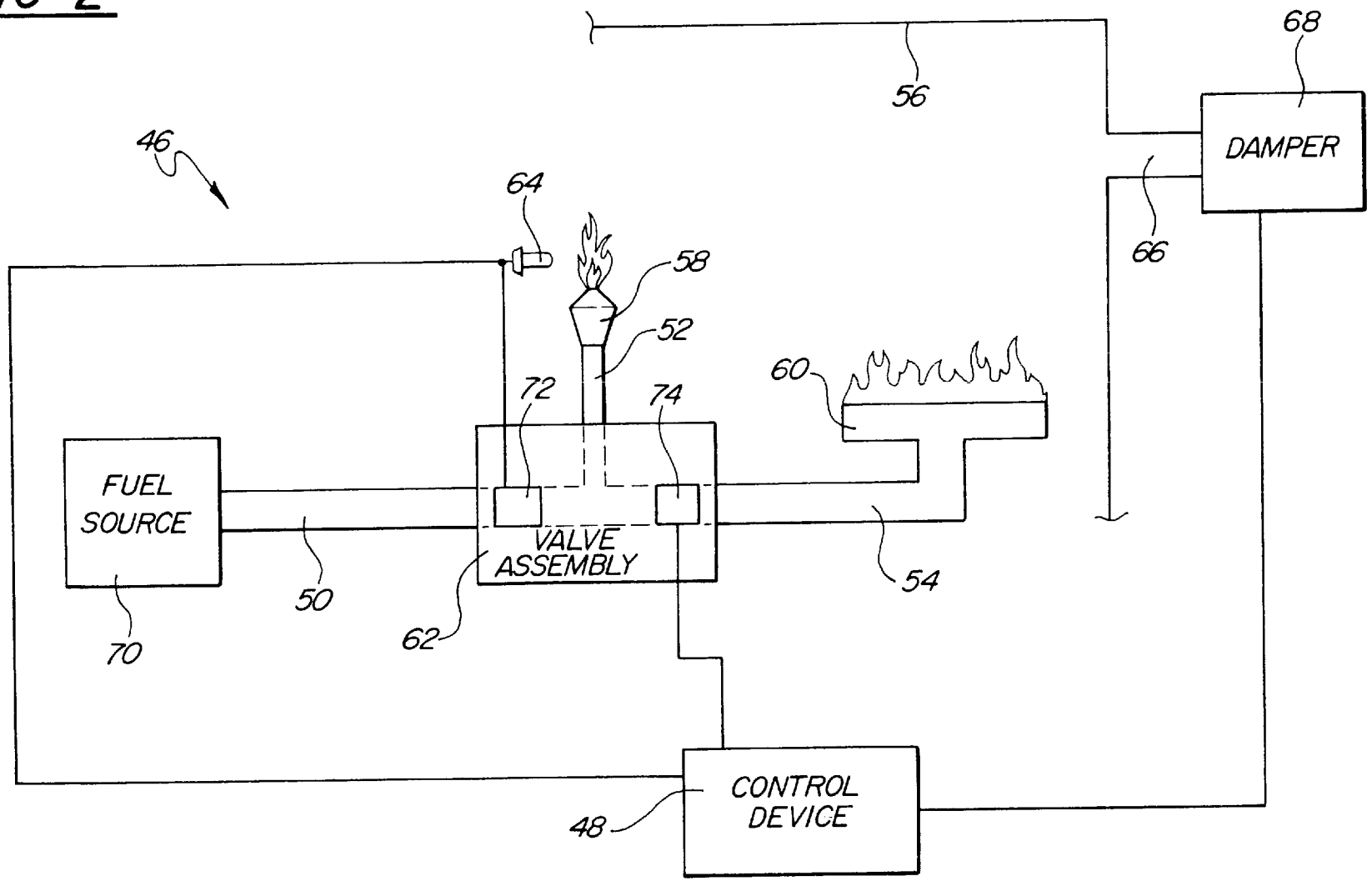
FIG. 2 is a diagrammatic view of a gas-fired appliance incorporating a control device in accordance with the present invention.

Referring now to the drawings wherein like reference numerals are used to identify identical components in the various views, FIG. 2 illustrates a gas-fired appliance 46 incorporating a control device 48 in accordance with the present invention. Appliance 46 may comprise a water heater, a space heater, fireplace or any other conventional gas-fired appliance. In addition to control device 48, appliance 46 may include several sections of gas pipe 50, 52, 54 a combustion chamber 56, a pilot burner 58, a main burner 60, a valve assembly 62, a thermoelectric device 64, an exhaust vent 66, and a damper 68.

Pipe sections 50, 52, 54 are provided to direct fuel gas received from a fuel source 70 to the pilot and main burners 58, 60 within appliance 46 and are conventional in the art. Section 50 is connected at one end to valve assembly 62 and at another end to fuel source 70. Fuel source 70 may be located at a distance remote from appliance 46 and additional sections of gas pipe may be used to connect fuel source 70 to pipe section 50. The fuel gas supplied by fuel source 70 may comprise natural gas, propane, butane or other conventional fuel gases. Section 52 is also connected at one end to valve assembly 62 and at another end to pilot burner 58. Finally, section 54 is also connected at one end to valve assembly 62 and at another end to main burner 60.

Combustion chamber 56 provides a space for burning the fuel gas provided by fuel source 70. Chamber 56 is conventional in the art and encompasses at least main burner 60.

Pilot burner 58 is provided to ignite main burner 60 upon the introduction of fuel gas to main burner 60. Pilot burner 58 is conventional in the art and preferably comprises a standing pilot burner (i.e., a continuously operating pilot burner).

Main burner 60 is provided to generate heat within appliance 46 to increase the temperature of water, air, or another medium depending upon the purpose for which appliance 46 is designed. Main burner 60 is also conventional in the art.

Figure 1:
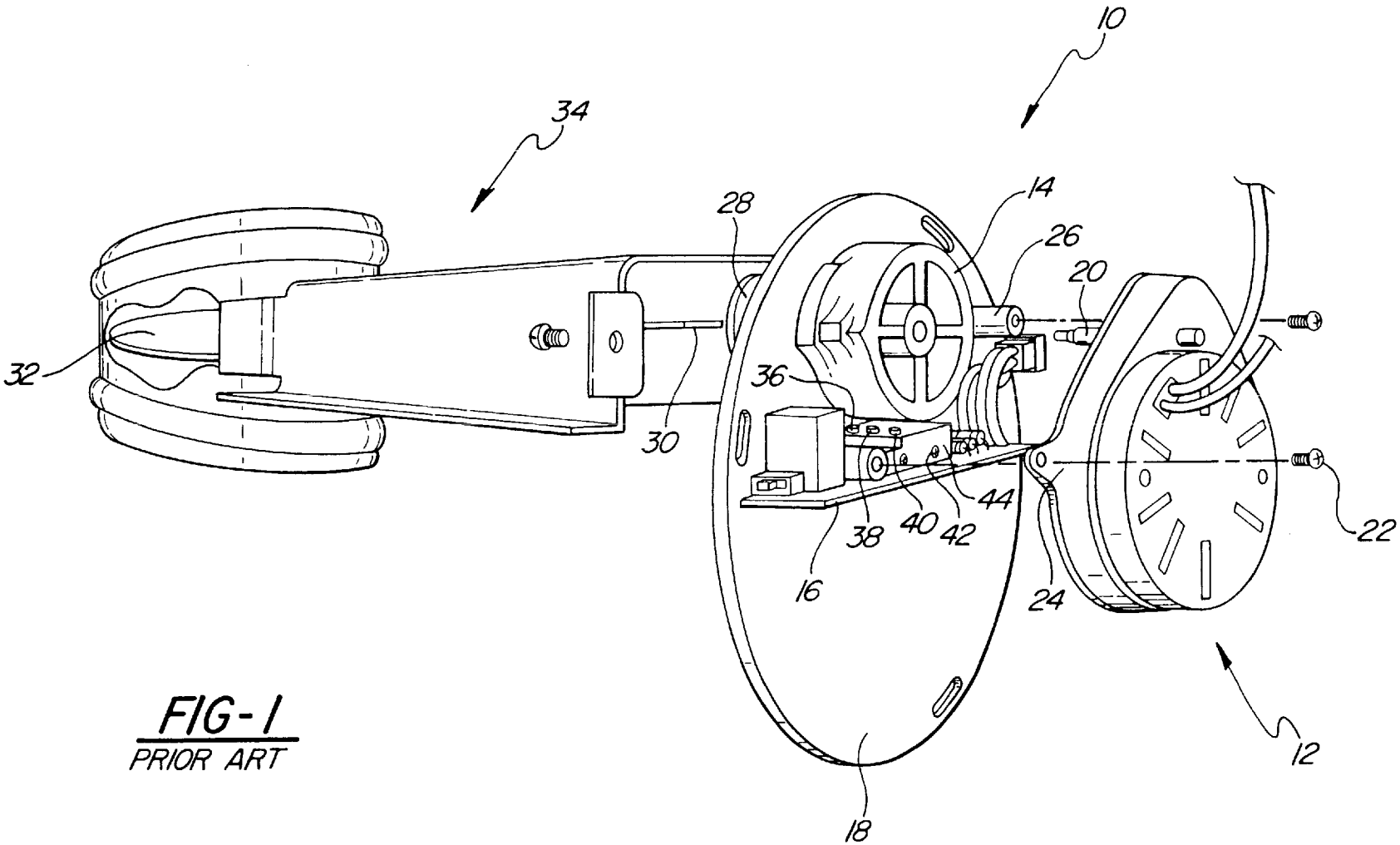
FIG-1 PRIOR ART
FIG. 1 is an exploded perspective view of a prior art control device coupled to a damper.

Valve assembly 62 is provided to control the passage of fuel gas from fuel source 70 to pilot burner 58 and main burner 60. Valve assembly 62 is conventional in the art and may comprise one of the 7000MVR Series of heating controls sold by Robertshaw Controls Company of Long Beach, California. Assembly 62 includes a pilot burner valve 72 and a main burner valve 74. Pilot burner valve 72 is disposed between fuel source 70 and pilot burner 58. Main burner valve 74 is disposed between fuel source 70 and main burner 60. As illustrated in FIG. 1, in order for fuel gas to reach main burner 60, the fuel gas must pass through pilot burner valve 72 in addition to main burner valve 74. Accordingly, the closure of pilot burner valve 72 will prevent fuel gas from reaching main burner 60.

Thermoelectric device 64 is provided to detect the presence of the pilot flame and to generate current for use by the electrically actuated components of appliance 46. Device 64 may be used to provide power to control device 48 for use in controlling damper 68 and main burner valve 74 as described and illustrated in commonly assigned U.S. Pat. No. 6,257,871 B1, the entire disclosure of which is incorporated herein by reference. Thermoelectric device 64 may comprise one or more thermopiles. Thermopiles are conventional in the art and may comprise the Model No. Q313 thermopile sold by Honeywell, Inc. of Morristown, N.J. Device 64 is disposed proximate pilot burner 58 and generates current in the presence of a pilot flame. The current generated by device 64 may be used to control pilot burner valve 72. In particular, the current may be used to power a solenoid to maintain valve 72 in an open position. If the pilot flame is extinguished, device 64 will cease generating current and valve 72 will close to prevent a further buildup of unburned gas within appliance 46. As set forth in U.S. Pat. 6,257,871 B1, the current generated by device 64 may also be provided to control device 48 for use in controlling damper 68 and main burner valve 74.

Exhaust vent 66 is provided to evacuate emissions, generated as a result of the combustion process, from the combustion chamber 56 in appliance 46. Vent 66 is conventional in the art. Vent 66 is coupled at one end to the combustion chamber 56 of appliance 46 and at a second end to a venting area, such as the outdoors, where emissions from the combustion process can be dissipated.

Figure 3:
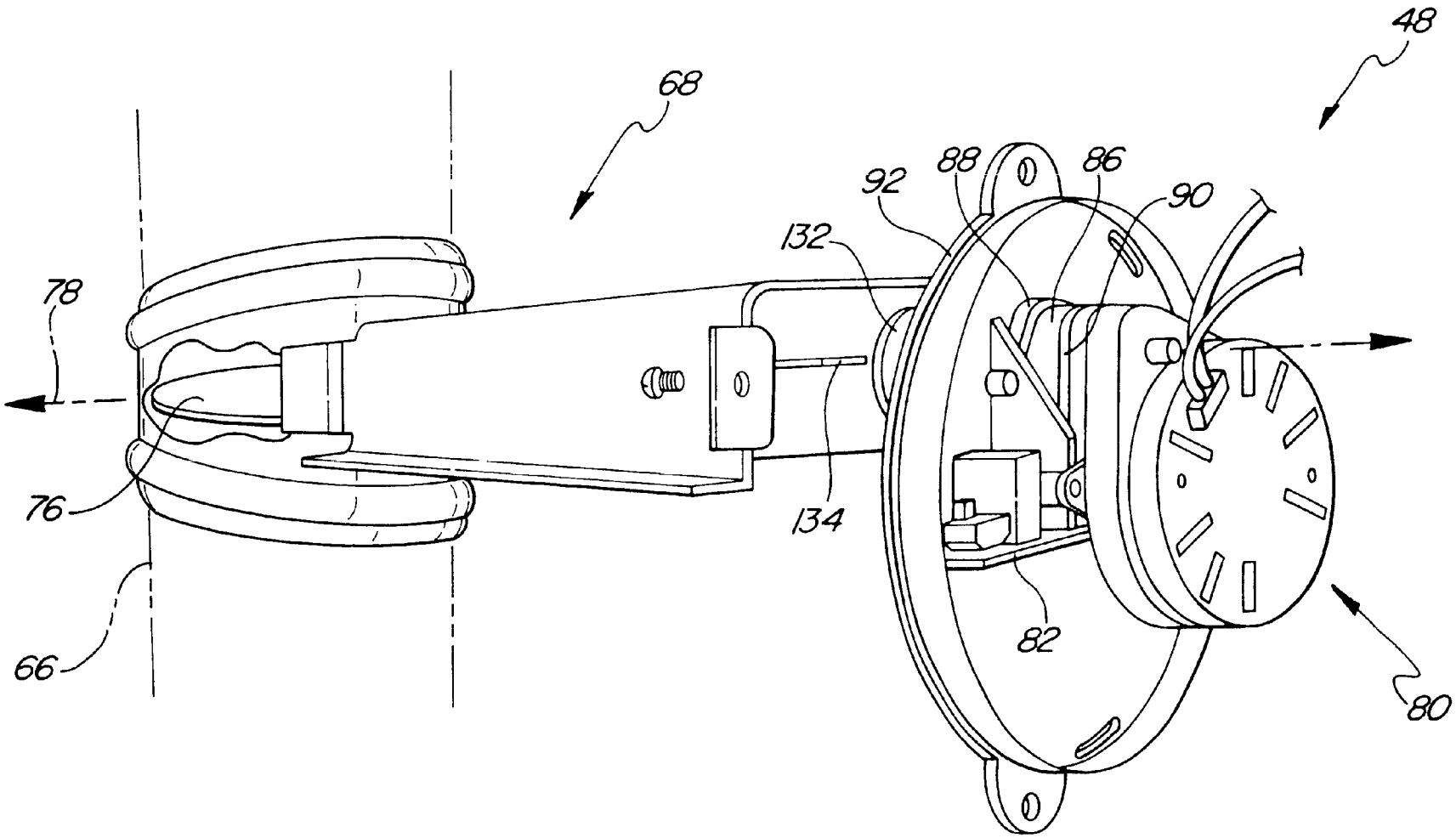
FIG. 3 is a partially exploded perspective view of a control device in accordance with the present invention coupled to a damper.

Damper 68 is provided to control the evacuation of heat from combustion chamber 56 through vent 66 in order to improve the efficiency of appliance 46. Damper 68 is conventional in the art and may comprise the Model No. RVGP-KSF damper sold by Effikal International, Inc., assignee of the present invention. Referring to FIG. 3, damper 68 is supported within vent 66 and includes a plate 76 that is rotatable about an axis 78 extending transversely to the longitudinal axis of vent 66 and to the direction of airflow through vent 66. As plate 76 rotates about axis 78, plate 76 assumes a plurality of angular positions including a closed position (illustrated in FIG. 3) in which damper 68 allows a minimum outflow of air from combustion chamber 56 and an open position in which damper 68 allows a maximum outflow of air from combustion chamber 56. Plate 76 preferably assumes a closed position immediately after main burner 60 is extinguished in order to reduce or eliminate the evacuation of heat through vent 66. Plate 76 preferably assumes an open position immediately prior to ignition of main burner 60 in order to allow the evacuation of emissions generated by the combustion process.

Figure 4:
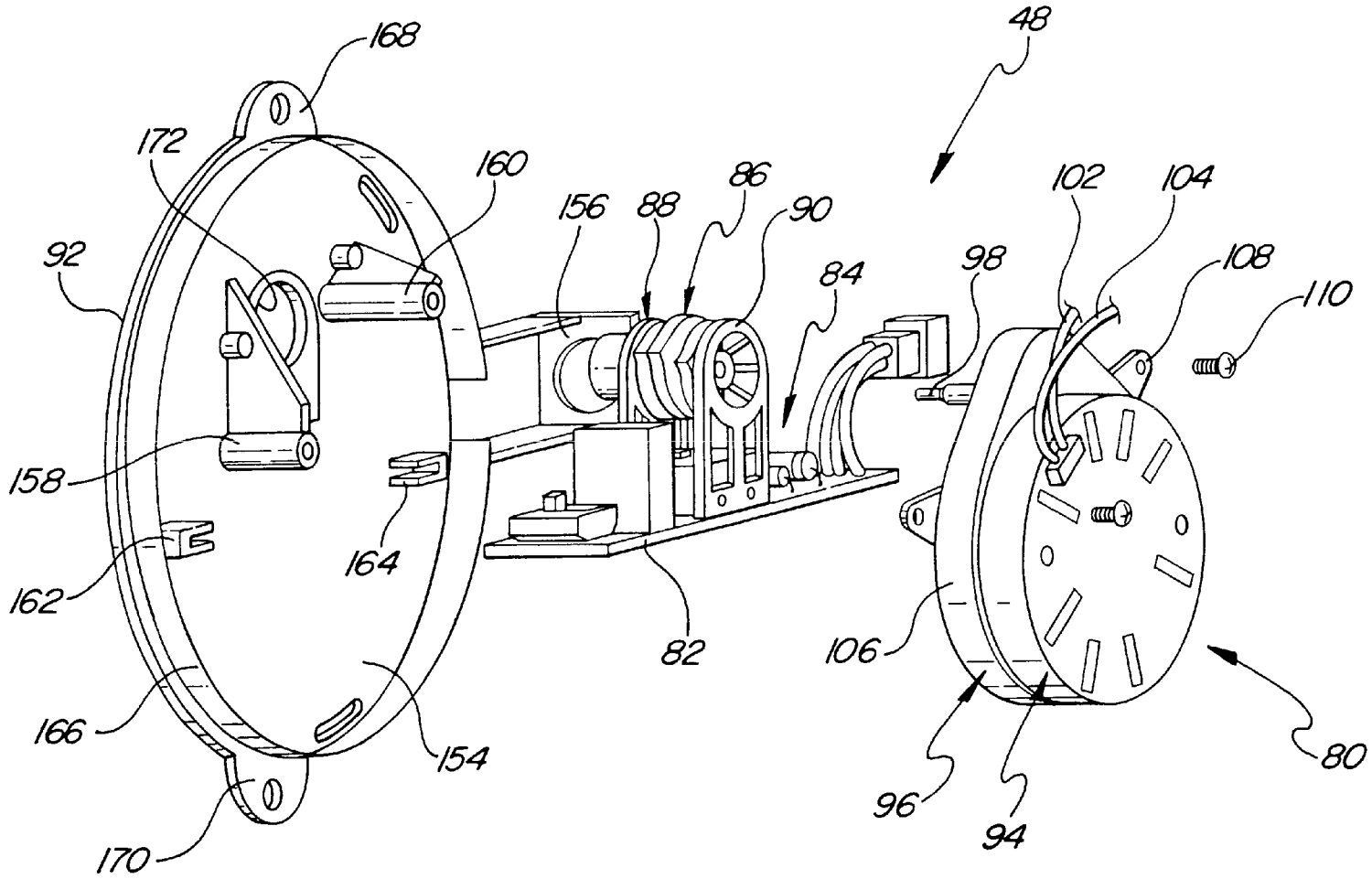
FIG. 4 is an exploded perspective view of the control device of FIG. 3.

Control device 48 is provided to control the operation of appliance 46, and particularly damper 68 and main burner valve 60. Referring to FIGS. 3–4, a control device 48 in accordance with the present invention may include a motor assembly 80, a printed circuit board 82, a control circuit 84, a cam 86, cam support members 88, 90 and a mounting plate 92.

Motor assembly 80 is provided to cause rotation of cam 86 and plate 76 of damper 68. In particular, motor assembly 80 is provided to cause plate 76 to rotate about axis 78 to open and close damper 68. Assembly 80 is conventional in the art and may include a motor 94, a gear assembly 96, and an output shaft 98.

Motor 94 is provided to generate a torque through which output shaft 98 is caused to rotate. Motor 94 is conventional in the art and may comprise a permanent magnet motor. Motor 94 may be disposed within a motor housing 100 and a pair of lead wires 102, 104 may extend from motor 94 for connection to a power source (not shown) as illustrated in FIGS. 3 and 4.

Gear assembly 96 provides relative rotation to output shaft 98 responsive to rotation of the rotor (not shown) of motor 94. Assembly 96 is conventional in the art and may comprise one or more gears disposed within a gear housing 106. Housing 106 may be coupled to housing 100 of motor 94 and may include one or more mounting flanges 108 through which fasteners 110 extend to connect motor assembly 80 to mounting plate 92.

Output shaft 98 is provided to transfer torque to cam 86 and plate 76 of damper 68. Shaft 98 is conventional in the art and may be disposed about axis 78. In the illustrated embodiment, shaft 98 is driven by motor 94 acting through gear assembly 96. It should be understood, however, that shaft 98 may alternatively be driven directly by motor 94 depending upon the requirements of the application.

Circuit board 82 provides a mounting and support surface for several of the components in control circuit 84 and for cam 86 as described in greater detail hereinbelow. Board 82 further provides conduction paths to direct current among the components of control circuit 84 and other components of device 48, such as motor 94. Circuit board 82 may be created in a conventional manner.

Control circuit 84 is provided to selectively transmit current to main burner valve 74 and to motor 94 to control the operation of main burner 60 and damper 68, respectively. Circuit 84 may comprise the control circuit described and illustrated in U.S. Pat. No. 6,257,871 B1. Referring to FIGS. 5–7, control circuit 84 may include a plurality of control switches 112, 114, 116, that are mounted on board 82. Switches 112,114, 116 may be disposed within a switch housing 118 that is also mounted on board 82. Housing 118 may include one or more apertures 120 for a purpose described hereinbelow.

Cam 86 is provided to control the state of control switches 112, 114, 116 and may be made from a variety of conventional plastics. Referring to FIGS. 5 and 7, cam 86 includes a plurality of cam surfaces 122, 124, 126 disposed about the circumference of cam 86 and configured to selectively actuate respective control switches 112, 114, 116 . A first end 128 of cam 86 defines a bore 130 configured to receive output shaft 98. A second end 132 of cam 86 is coupled to a shaft 134 which is in turn coupled to plate 76 of damper 68. Rotation of output shaft 98 causes rotation of cam 86 and, therefore, shaft and plate 76 about axis 78.

Cam support members 88, 90 are provided, in accordance with the present invention, to support cam 86 on circuit board 82 and position cam 86 relative to control switches 112, 114, 116. Members 88, 90 may be made from a variety of conventional plastics and are supported on circuit board 82 and spaced from one another. Referring to FIG. 5, each member 88, 90 includes a cam receiving portion 136, 138, respectively, and a mounting portion 140, 142, respectively.

Cam receiving portions 136, 138 are provided to receive and support ends 132, 128 of cam 86, respectively. In the illustrated embodiment, portions 136, 138 are shaped in the form of a ring and define apertures 144, 146 sized to receive and support the respective ends 132, 128 of cam 86 while allowing relative rotation of cam 86. It should be understood, however, that cam receiving portions 136, 138 may be formed in a variety of ways provided portions 136, 138 support cam 86 and position cam 86 relative to switches 112, 114, 116 while allowing relative rotation of cam 86. Further, it should be understood that the shape and size of portions 136, 138 may vary depending upon the shape and size of ends 132, 128 of cam 86.

Mounting portions 140, 142 provide a means for securing members 88, 90 to circuit board 82. In the illustrated embodiment, mounting portions 140, 142 are bar-shaped and include one or more apertures 148 extending therethrough. Apertures 148 are aligned with apertures 120 in switch housing 118 and are configured to receive fasteners 150. Each fastener 150 extends through an aperture 148 of one of members 88, 90, through an aperture 120 in switch housing 118 and through an aperture 148 of another of members 88, 90. Although one embodiment of mounting portions 140, 142 is illustrated in the drawings, it should be understood to those of skill in the art that mounting portions 140, 142 may be configured in a variety of ways provided the mounting portions 140, 142 enable accurate positioning of cam receiving portions 136, 138 and, therefore, cam 86. As will be readily apparent to those of skill in the art, mounting portions 140, 142 may also be connected to cam receiving portions 136, 138 in a variety of ways. In the illustrated embodiment, cam receiving portions 136,138 and mounting portions 140, 142 are connected by a plurality of support legs 152 extending in a direction perpendicular to the axis of rotation of cam 86.

Mounting plate 92 provides support for several of the components of control device 48 and provides a means for mounting device 48 within appliance 46. Plate 92 may be made from a variety of conventional metals and plastics. In a preferred embodiment, however, plate 92 is made of plastic through an injection molding process to reduce the weight and cost of device 48. Plate 92 includes a body portion 154, an arm 156, a pair of mounting posts 158, 160, and a pair of board receiving members 162, 164.

Body portion 154 provides structural support for several of the components of device 48. Portion 154 is generally circular in shape and is centered about an axis 78. It should be understood, however, that the shape of portion 154 may vary. Portion 154 includes a skirt 166 disposed about the circumference of body portion 154 and extending in a direction substantially parallel to axis 78. Portion 154 further includes a pair of mounting flanges 168, 170 by which plate 92 may be mounted within appliance 46 and an aperture 172 through which end 132 of cam 86 extends.

Arm 156 is provided to receive and position a wire harness or other electrical connector to connect the components of control circuit 84 disposed on board 82 with those components of circuit 84 that are remote from board 82. Arm 156 may extend in a direction substantially perpendicular to axis 78.

Posts 158, 160 are provided to mount motor assembly 80 to plate 92. Posts 158, 160 extend in a direction parallel to axis 78 and include bores configured to align with apertures in mounting flanges 108 of gear housing 106. The bores are configured to receive fasteners 110 extending through flanges 108.

Board receiving members 162, 164 are provided to support and position circuit board 82. Members 162, 164 are substantially C-shaped in cross-section-opening toward one another-and extend from body portion 154 in a direction substantially parallel to axis 78.

Referring again to FIG. 4, a method of assembling device 48 may first include the step of mounting components of control circuit 84 onto circuit board 82. The method of assembly may then include the step of securing cam 86 to circuit board 82. This step may include the substeps of: (i) inserting ends 132, 128 of cam 86 into cam receiving portions 136, 138 of support members 88, 90; (ii) aligning apertures 148 of mounting portions 140, 142 of members 88, 90 with apertures 120 in switch housing 118; and (iii) inserting fasteners 150 through apertures 148 and 120. The method of assembly may then include the step of positioning circuit board 82 with respect to mounting plate 92 by inserting board 82 into the channels defined by receiving members 162, 164. Finally, the method of assembly may include the step of coupling motor assembly 80 to mounting plate 92. This step may include the substeps of aligning mounting flanges 108 of assembly 80 with posts 158, 160 of plate 92 and inserting fasteners 110 through flanges 108 into posts 158, 160.

A device in accordance with the present invention for controlling a gas-fired appliance represents a significant improvement over conventional control devices. In particular, the use of cam support members 88, 90 in the inventive control device 48 allows the cam 86 to be positioned relative to the circuit board 82 rather than the mounting plate 92. As a result, an accurate positional relationship between the cam 86 and the control switches 112, 114, 116 is ensured. Second, the inventive control device 48 is less expensive than conventional control devices because it requires fewer parts, may be assembled more quickly, and uses an injection-molded plastic mounting plate 92 as opposed to a stamped metal mounting plate.

While the invention has been particularly shown and described with reference to the preferred embodiments thereof, it is well understood by those skilled in the art that various changes and modifications can be made in the invention without departing from the spirit and scope of the invention.

I claim:

1. A device for controlling a gas-fired appliance, comprising:

a motor assembly having a shaft extending therefrom;

a cam coupled to said shaft for rotation therewith, said cam coupled to a plate of a damper and said plate configured to rotate with said cam; and a printed circuit board having a first control switch mounted thereon;

wherein said cam is configured to selectively actuate said first control switch and said cam is supported on said printed circuit board.

2. The device of claim 1, further comprising a first cam support member supported on said printed circuit board.

3. The device of claim 2 wherein said first cam support member includes an aperture configured to receive a portion of said cam.

4. The device of claim 2 wherein said first cam support member is coupled to a housing for said first control switch, said housing mounted on said printed circuit board.

5. The device of claim 2 further comprising a second cam support member supported on said printed circuit board and spaced from said first cam support member.

6. The device of claim 5 wherein said first and second cam support members are coupled to opposite sides of a housing for said first control switch.

7. A device for controlling a damper in a gas-fired appliance, comprising:

a mounting plate;

a motor assembly coupled to said mounting plate and having a shaft extending therefrom;

a cam coupled to said shaft for rotation therewith, a plate of said damper coupled to said cam for rotation therewith; and a printed circuit board supported by said mounting plate and having a first control switch mounted thereon;

wherein said cam is configured to selectively actuate said first control switch and said cam is supported on said printed circuit board.

8. The device of claim 7 wherein said mounting plate comprises a receiving member extending therefrom, said receiving member configured to receive a portion of said printed circuit board.

9. The device of claim 7, further comprising a first cam support member supported on said printed circuit board.

10. The device of claim 9 wherein said first cam support member includes an aperture configured to receive a portion of said cam.

11. The device of claim 9 wherein said first cam support member is coupled to a housing for said first control switch, said housing mounted on said printed circuit board.

12. The device of claim 9 further comprising a second cam support member supported on said printed circuit board and spaced from said first cam support member.

13. The device of claim 12 wherein said first and second cam support members are coupled to opposite sides of a housing for said first control switch.

14. A device for controlling a damper in a gas-fired appliance, comprising, in combination:

a plastic mounting plate;

a motor assembly coupled to the mounting plate and having a shaft extending therefrom;

a cam coupled to the shaft and a damper plate coupled to said cam for rotation therewith; and a printed circuit board supported by the mounting plate and having a first control switch mounted thereon;

wherein the cam is configured to selectively actuate the first control switch and the cam is supported on the printed circuit board.

15. The device of claim 14 wherein the mounting plate comprises at least one post formed as a single piece with the mounting plate, and the motor assembly is mounted to the mounting plate at the at least one post.

16. The device of claim 14, further comprising a first cam support member supported on said printed circuit board.

17. The device of claim 14 wherein the mounting plate comprises an arm adapted to receive a wire harness, wherein the arm is formed as a single piece with the mounting plate.

18. The device of claim 16 wherein said first cam support member is coupled to a housing for said first control switch, said housing mounted on said printed circuit board.

19. The device of claim 16 further comprising a second cam support member supported on said printed circuit board and spaced from said first cam support member.

20. The device of claim 19 wherein said first and second cam support members are coupled to opposite sides of a housing for said first control switch.

* * * * *